United States Patent [19]

Veyrassat

[11] 4,030,673

[45] June 21, 1977

[54] DOUBLE WIRE-WINDING MACHINE WITH AUTOMATIC TRANSFER

[75] Inventor: Louis Veyrassat, Rolle, Switzerland

[73] Assignee: Maillefer S.A., Switzerland

[22] Filed: Sept. 8, 1975

[21] Appl. No.: 611,147

[30] Foreign Application Priority Data

Sept. 27, 1974 Switzerland ..... 13126/74

[52] U.S. Cl. ..... 242/25 A

[51] Int. Cl.² ..... B65H 67/04

[58] Field of Search ..... 242/25 A, 25 R, 18 A

[56] References Cited

UNITED STATES PATENTS

| | | | |
|---|---|---|---|
| 3,441,229 | 4/1969 | Henrich | 242/25 A |
| 3,695,527 | 10/1972 | Kobayashi et al. | 242/25 A |
| 3,761,030 | 9/1973 | Leinonen et al. | 242/25 A |
| 3,913,858 | 10/1975 | Ikegami | 242/25 A |

*Primary Examiner*—Stanley N. Gilreath

*Attorney, Agent, or Firm*—Stevens, Davis, Miller & Mosher

[57] ABSTRACT

A double winding machine for winding metal wire and having an automatic wire-transfer device which includes a support, two pairs of coaxial reel-spindles borne by the support, and at least two reels. Each reel is provided with a wire-securing groove and is adapted to be held by a respective one of pairs of reel-spindles.- The machine also includes two snagging members, each mounted on a respective one of the reel spindles of each of the pairs, and a deflection device operated at the time of transfer for changing the path of travel of the wire. The deflection device includes a wire-pushing mechanism adapted to engage the wire in the snagging member associated with an empty reel, a deflector adapted to cause relative displacement of the path of travel of the wire with respect to a full reel for engaging the wire in the securing groove of that reel, and a control for actuating the deflector just prior to the wire-pushing mechanism.

6 Claims, 6 Drawing Figures

DOUBLE WIRE-WINDING MACHINE WITH AUTOMATIC TRANSFER

Figure 1:
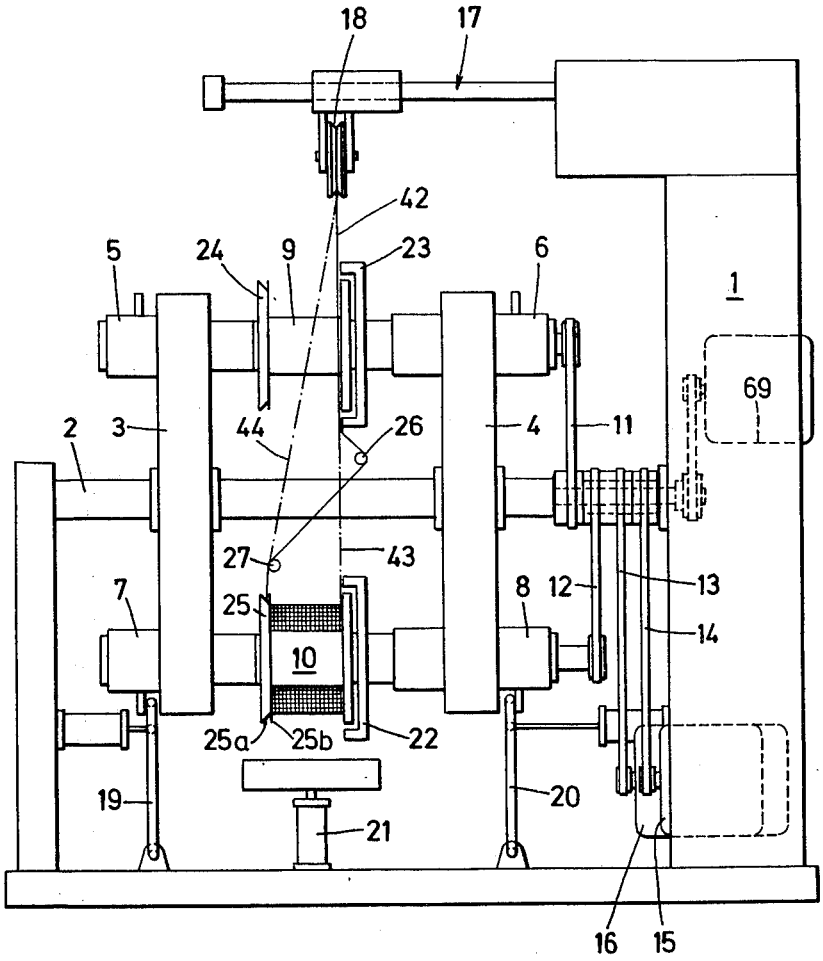

This invention relates to a double winding machine for winding metal wire and having an automatic wire-transfer device, the machine comprising a support, two pairs of coaxial reel-spindles borne by the support, at least two reels, each provided with a wire-securing groove and adapted to be held by a respective pair of reel-spindles, two snagging members, each mounted on a respective reel-spindle of each of the pairs, and a deflection device operated at the time of transfer for changing the path of travel of the wire.

In the known double winding machines of this kind, when the wire is transferred from the full reel to the empty one, it is snagged by the snagging member associated with the empty reel, thus causing the wire to be broken or cut off between the snagging member and the full reel. Winding of the wire on the empty reel then begins immediately, while the full reel is slowed down and then stopped so that it may be removed. While it is thus being slowed down, the free end of the wire whips about the end flange of the full reel near which it has been broken off. The resultant drawbacks are particularly that the end of the wire is damaged, scraps of metal fall on the machine, and, if the wire is insulated, some of the turns wound on the full reel are also damaged. In order to remedy these drawbacks, provision has already been made for associating or combining with the snagging member a channel which receives and guides the free end of the wire on the full reel. However, this arrangement does not eliminate one other drawback of the known winding machines of the above-mentioned type, viz., that the wire is not firmly secured to the full reel, so that a number of turns may unwind during stopping and removal. Until now, this drawback has prevented the winding operations from being as fully automated as possible, for it was always necessary that a worker secure the end of the wire to the end flange of the reel when the latter was ready to be removed.

In the case of relatively small reels, on the order of 20 cm. in length and in diameter, for instance, intended to hold fine telephone wire, the transfer takes place several times a minute, so that this last drawback has entailed relatively high personnel costs. In order to facilitate securing the end of the wire to the reel and to prevent the unwinding of numerous turns, reels have recently been produced which have one of their end flanges provided with a securing groove, one side of which has resilient tongues distributed along its circumference and arranged so as to be able to grip the wire after it has simply been engaged in the groove. It was therefore expedient to produce a winding machine which would automatically engage the wire in the securing groove of these reels at the time of transfer.

It is a main object of this invention to provide a winding machine of the kind described initially which is designed to bring about that engagement automatically.

Figure 2:
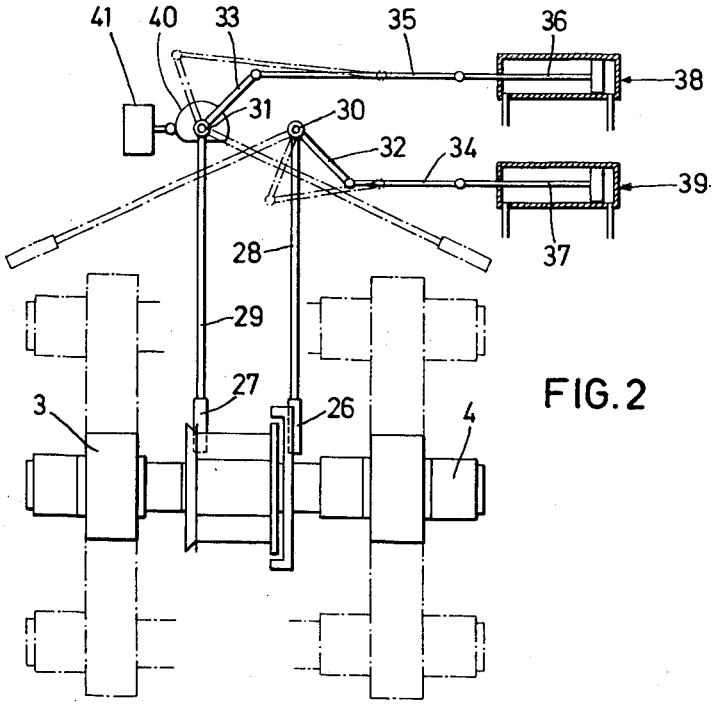
Figure 3:
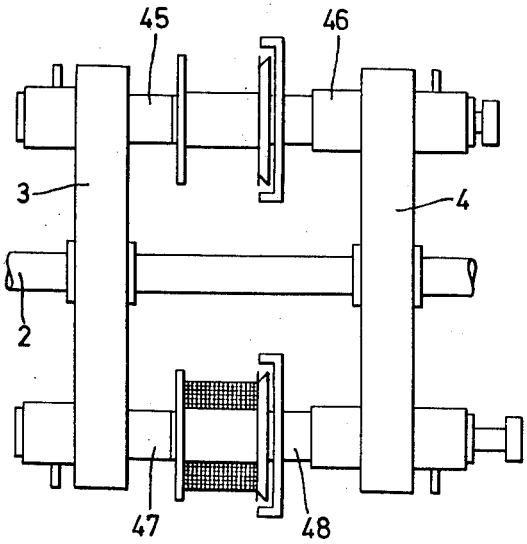
Figure 4:
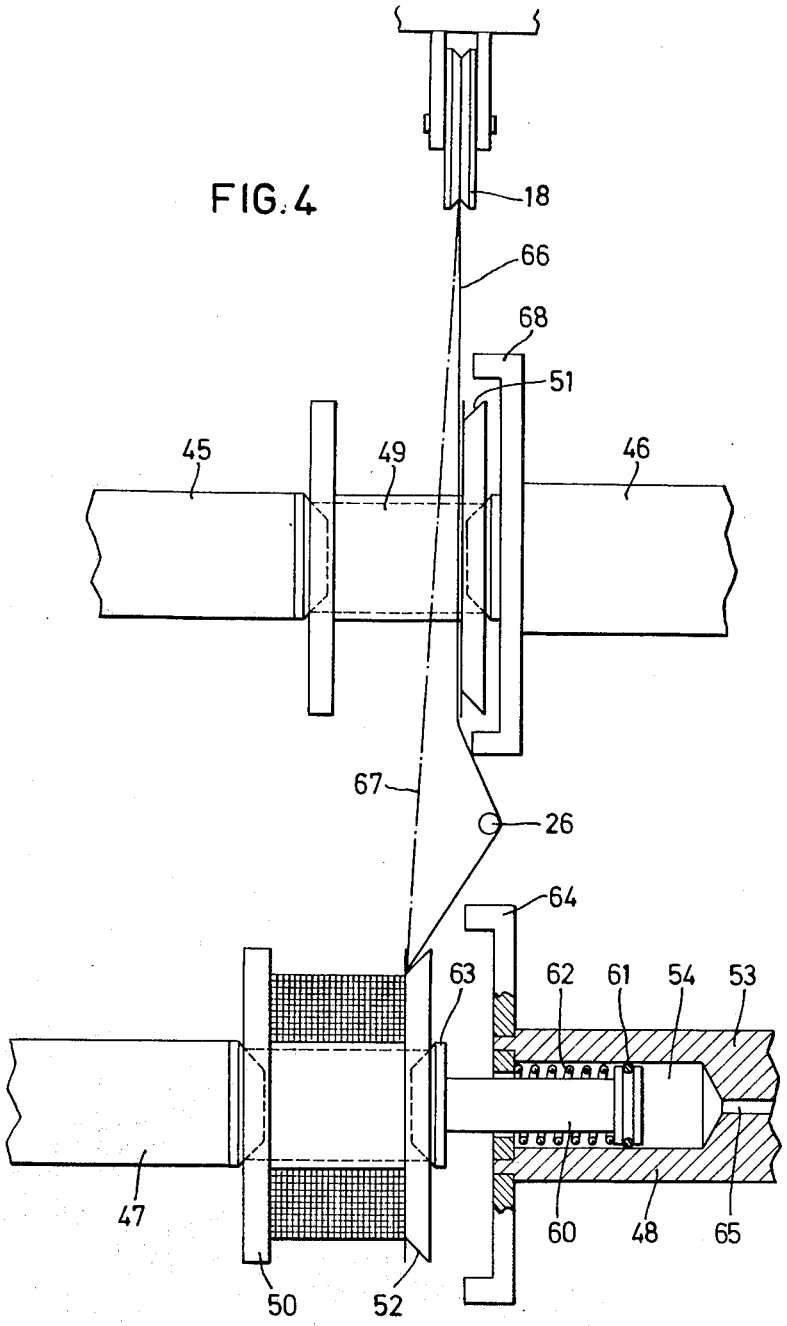
Figure 5:
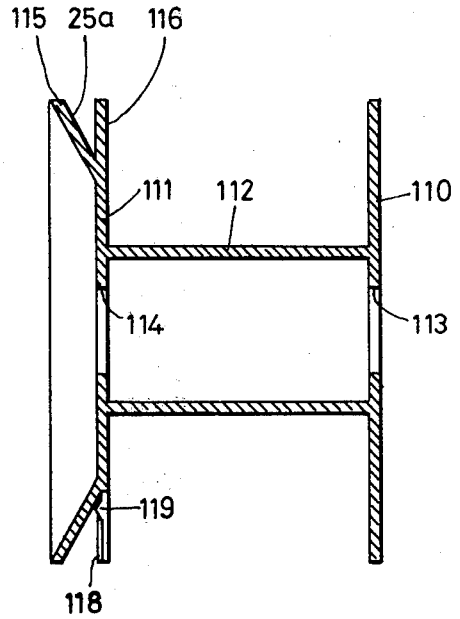
Figure 6:
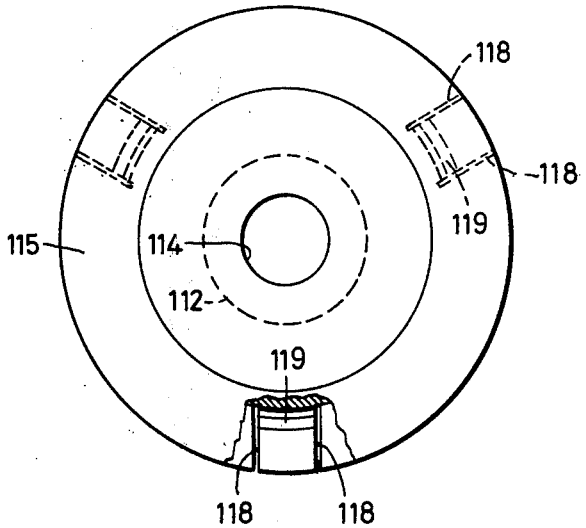

To this end, in the winding machine according to the present invention, the deflection device comprises wire-pushing means adapted to engage the wire in the snagging member associated with an empty reel, a deflector adapted to cause a relative displacement of the path of travel of the wire with respect to a full reel in the vicinity thereof for engaging the wire in the securing groove of this reel, and control means for actuating the deflector just before the wire-pushing means engages the wire in the snagging member. Two possible embodiments of the invention will now be described in detail with reference to the accompanying drawings, in which:

FIG. 1 is a general elevation of the winding machine according to the first embodiment, FIG. 2 is a partial top plan view of this winding machine, FIG. 3 is a partial elevation of the winding machine according to the second embodiment, FIG. 4 is a larger-scale view, partially in section, of certain elements of the winding machine according to the second embodiment, FIG. 5 is a cross-sectional view of a reel, and FIG. 6 is an end view, partly in section, of the reel shown in FIG. 5.

The winding machine shown in FIG. 1 is of the type having a rotary cage. It comprises a rigid frame 1 on which is pivoted a shaft 2, disposed horizontally and bearing the cage, two support elements 3 and 4 of which are integral with the shaft 2. Two pairs of reel-spindles 5, 6 and 7, 8 are mounted at the ends of the support elements 3 and 4. Their axes are parallel to that of the shaft 2, and they are arranged to carry two reels 9 and 10. Motors 15 and 16 operate the driving spindles 6 and 8 via belts 11, 12, 13, and 14, while a motor 69 housed in the frame 1 causes the cage (2,3,4) to rotate by 180° at the time of each transfer. A traverse mechanism 17 is mounted on the frame 1 above the cage. It comprises a pulley 18 which reciprocates so as to guide the wire being wound on whichever of the reels 9 or 10 is in the upper position. An unloading device comprising two arms 19 and 20 disposed in the lower part of the frame 1 makes it possible to retract the reel-spindles carrying the full reel, against the force of return springs, after the cage has rotated and the wire has been transferred to the upper reel. The full reel (10) then reaches a receiving device 21, whence it is directed towards a storage area, while another, empty reel automatically replaces the one just removed. The device 21 comprises a lift operated by a jack. The control arms 19 and 20 are likewise controlled by jacks.

Each of the driving spindles 6 and 8 is equipped with a snagger 22, 23 in the form of a disc provided with a rim which covers one of the end flanges of the reel driven by the spindle. The snaggers 22 and 23 are provided with hooks (not shown) situated in line with the flange of the respective reel.

The winding machine shown in FIG. 1 is adapted to receive reels 9 and 10, each having an end flange equipped with a securing groove 24 and 25, respectively. Reels of this kind are already known per se. The securing groove may, for example, include an inclined side **25*a* situated towards the outside and a side 25*b* perpendicular to the axis, having resilient tongues distributed along the circumference of the groove and provided with triangular projections which, whenever a wire is engaged in the groove, clamp it against the inclined side and thus secure it. A reel 10 is shown in FIGS. 5 and 6. It comprises a right flange 110, a left flange 111 and a cylindrical drum portion 112. Both flanges are provided with circular openings 113 and 114 respectively which engage the inner ends of the spindles 7, 8 or 5, 6 when the reel is mounted on the winding machine. The left flange 111 comprises a frustoconical wall portion 115 extending along its periphery and a plane annular wall portion 116. Both said wall portions 115 and 116 limit a groove 25 of triangular cross section having inner faces 25a and 25b respectively. A plurality of radial resilient tongues 117 are regularly distributed along the groove 25. Each tongue is formed of a length section of wall portion 116 limited by a pair of parallel slits 118, 118 provided through the wall portion 116. Each tongue further comprises a projection 119 of triangular shape formed thereon. It follows from FIG. 5 that the end of a wire wound on the drum portion 112 may be inserted in the groove 25 and that it is then clamped in that groove through the tongues 117. In the winding machine shown in the drawing, the reels are mounted in such a way that the flanges having the securing grooves 24 and 25 are on the opposite side from the snaggers 23 and 22.**

The winding machine is further equipped with a deflection device comprising two pivoting arms 28 and 29 having sleeves 26 and 27 at their ends. The arms 29 and 29 are disposed horizontally (FIG. 2). They pivot about vertical spindles 30 and 31 placed in such a way that the sleeves 27 and 26 can move into a position facing the support elements 4 and 3, respectively, when the cage is in a vertical position, i.e., that shown in solid lines in FIG. 2. Each of the arms 28 and 29 pivots between a starting position shown in dot-dash lines in FIG. 2 and the engaged position shown in solid lines. It will be noted that in the starting position, the arms 28 and 29 are far enough away from the machine that the support elements 3 and 4 of the cage are free to carry out the rotation which takes place upon each transfer. The dot-dash outline shows the cage in its horizontal position. The arms 28 and 29 are equipped with levers 32 and 33 linked by rods 34, 35 to pistons 36, 37 of two jacks 38, 39 which operate the arms 28 and 29. Moreover, the arm 29 bears a cam 40 which cooperates with a fixed contact 41. The cam 40 and the contact 41 are so disposed that the contact 41 is actuated whenever the arm 29 reaches the position shown in solid lines in FIG. 2. The jacks 38, 39 are controlled, for example, by electrically-operated valves connected to a control circuit comprising the contact 41, which is in turn connected to the valves controlling the jack 39. The control circuit also comprises contacts actuated by the cage or connected to the device controlling the motor 69. The operation of the contact 41 causes the jack 39 to be actuated, so that the arm 28 moves from the dot-dash line position into the solid line position. The jack 38 is operated at each pivoting movement of the cage, immediately after that movement has taken place. In FIG. 1, the sleeves 26 and 27 are seen in their engaged position. As the cage has just rotated, a wire 42 coming from a production line and passing over the pulley 18 follows the path of travel shown in solid lines. Thus it passes over the barrel of the empty reel 9 and along the end flange engaged in the disc 23, then it is deflected to pass over the sleeve 26 of the wire-pusher so that it comes in contact with the rim of the disc 23. It is then deflected at an angle by the deflector sleeve 27 so as to pass into the securing groove 25 of the reel 10.

This path of travel is attained in two phases. Starting from the path travelled by the wire 42 immediately after rotation of the cage, i.e., the path indicated by a dot-dash line 43, a first deflection to the path indicated by a line 44 was caused by the right-to-left movement of the arm 29 of the deflector, bringing the sleeve 27 into the position it occupies in FIG. 1, after which the wire-pusher arm 28, moving the sleeve 26 from the left to right, brought the wire into the path shown in solid lines. At that moment, one of the hooks on the rim of the disc 23 snags the wire and breaks it between the two reels, at the same time starting the winding on the barrel of the reel 9. Owing to the traction exerted on the section of wire situated between the disc 23 and the reel 10 at the time of breakage, the turns engaged in the securing groove 25 tighten under the securing tongues distributed along the side **25*b* of the groove 25, so that the end of the wire is secured to the reel 10. This reel may thus be removed by means of the members 19, 20, and 21 after the reel-spindles 7 and 8** have stopped. Hence no manual intervention is necessary, and the full reels may be removed and directed towards a storage location by automatic means.

FIGS. 3 and 4 show another embodiment of the winding machine according to the invention. It, too, is a winding machine of the type having a rotary cage, the general arrangement of which is the same as that of FIG. 1. This winding machine also includes a wire-pusher, the sleeve 26 of which is seen in FIG. 4. Reel-spindles 45, 46, 47, 48 mounted on the support elements 3 and 4 are designed somewhat differently from the reel-spindles 5-8. The reel-spindles 45 and 47 are adapted to receive those end flanges of reels 49 and 50 which are opposite the end flanges equipped with securing grooves 51 and 52. (FIG. 4). As for the reel-spindles 46 and 48, they include—as may be seen in connection with the reel-spindle 48—a cylindrical body 53 having a housing 54 constituting the cylinder of a jack. At the end of a piston 60, which slides with a gasket 61 in the housing 54 and is acted upon by a return spring 62, is the head 63 of the reel-spindle 48, which is equipped with a means (not shown) for driving the reel 50. A snagger 64 associated with the reel-spindle 48 is integral with the body 53. Otherwise, it is constructed the same as the snaggers 22 and 23. The piston 60 is operated via an air inlet 65. It will be understood that the reel-spindle 46 includes the same elements as the reel-spindle 48.

FIG. 4 shows the arrangement of the reels 49 and 50 just after rotation of the cage and corresponds to the position shown in FIG. 1. In this embodiment, the wire-pusher arm 28, equipped with the sleeve 26, has been retained. Its arrangement and operation are the same as may be seen in FIG. 2. The deflection mechanisms associated with the reel-spindles 46 and 48, on the other hand, replace the deflector arm 29 and its control mechanism. Just after rotation of the cage, when the pulley 18 is in the position shown in FIG. 4, the deflection mechanism associated with the reel-spindle 48 is actuated, thus causing the piston 60 to move into the position shown in the drawing. The reel-spindle 47 likewise moves axially against the force of its return spring, so that the full reel is displaced, thus causing the path of travel of the wire 66 to be modified as shown by the dot-dash line 67 and, consequently, the engagement of the wire in the securing groove 52 of the reel 50. Immediately after this engagement, the arm 28 is caused to move in such a way that its sleeve 26, moving from left to right, imparts to the wire the path of travel shown in solid lines, thus causing it to be snagged by the disc 68 integral with the body of the reel-spindle 46. In this manner as well, the last turns wound on the reel 50 are engaged and gripped in the securing groove 52 without manual intervention, so that the full reel can be removed and replaced by an empty reel completely automatically.

What is claimed is:

1. A double winding machine for winding metal wire and having an automatic wire-transfer device, said machine comprising a support, two pairs of coaxial reel-spindles borne by said support, at least two reels, each provided with a wire-securing groove and adapted to be held by a respective said pair of reel-spindles, two snagging members, each mounted on a respective said reel-spindle of each of said pairs, and a deflection device operated at the time of said transfer for changing the path of travel of said wire, wherein said deflection device comprises wire-pushing means adapted to engage said wire in a said snagging member associated with an empty said reel, a deflector adapted to cause relative displacement of said path of travel of said wire with respect to a full said reel in the vicinity thereof for engaging said wire in said securing groove of said full reel, and control means for actuating both said wire-pushing means and said deflector, said control means being arranged for actuating said deflector just prior 2. A winding machine in accordance with claim 1, wherein said deflector and said wire-pushing means take the form of two pivoting arms, each said arm being movable between a rest position and a position of engagement.

3. A winding machine in accordance with claim 2, wherein the pivoting axes of said arms are parallel.

4. A winding machine in accordance with claim 2, further comprising at least two jacks, each said arm being actuated by a said jack.

5. A winding machine in accordance with claim 4, further comprising a contact actuated by said deflector arm when said deflector arm reaches said position of engagement, said contact controlling said jack actuating said wire-pushing arm.

6. A double winding machine for winding metal wire and having an automatic wire-transfer device, said machine comprising a support, two pairs of coaxial reel-spindles borne by said support and axially movable between a rest position and a deflection position, at least two reels, each provided with a wire-securing groove and adapted to be held by a respective said pair of reel-spindles, two snagging members, each mounted on a respective said reel-spindle of each of said pairs. a wire pushing means operated at the time of said transfer for engaging said wire in a said snagging member associated with an empty said reel, displacement means for axially displacing a said pair of reel-spindles associated with a full said reel, for engaging said wire in said securing groove of said full reel, and control means for actuating said wire pushing means and said displacement means, said control means being arranged for actuating said displacement means just prior to said wire-pushing means.

* * * * *